US008947313B2

(12) United States Patent
Fong

(10) Patent No.: US 8,947,313 B2
(45) Date of Patent: Feb. 3, 2015

(54) RADIAL-FREE COLLINEAR OMNI-DIRECTIONAL ANTENNA WITH GAIN AND VIRTUAL GROUND

(76) Inventor: Edison Fong, Sunnyvale, CA (US)

( * ) Notice: Subject to any disclaimer, the term of this patent is extended or adjusted under 35 U.S.C. 154(b) by 1116 days.

(21) Appl. No.: 12/927,397

(22) Filed: Nov. 15, 2010

(65) Prior Publication Data

US 2012/0119968 A1 May 17, 2012

(51) Int. Cl.
*H01Q 9/04* (2006.01)
*H01Q 9/42* (2006.01)
*H01Q 9/30* (2006.01)

(52) U.S. Cl.
CPC ... *H01Q 9/42* (2013.01); *H01Q 9/30* (2013.01)
USPC ..... 343/825

(58) Field of Classification Search
CPC ..... H01Q 1/243; H01Q 9/40; H01Q 9/30
USPC ..... 343/790–792
See application file for complete search history.

(56) References Cited

U.S. PATENT DOCUMENTS

| | | | | |
|---|---|---|---|---|
| 2,124,424 | A * | 7/1938 | McConnell | 343/825 |
| 4,675,687 | A * | 6/1987 | Elliott | 343/715 |
| 4,764,773 | A * | 8/1988 | Larsen et al. | 343/713 |
| 6,191,747 | B1 * | 2/2001 | Cosenza | 343/749 |

* cited by examiner

*Primary Examiner* — Dameon E Levi
*Assistant Examiner* — Hasan Islam
(74) *Attorney, Agent, or Firm* — Michael A. Kaufman, Esq.

(57) ABSTRACT

An omni-directional antenna operable absent ground radials and providing at least 3 dB gain at a chosen wavelength relative to a dipole includes first and second like-oriented J-pole antennas and, coupled intermediate said J-pole antennas, a quarter-wavelength non-radiating delay line. Each J-pole antenna includes a half-wave radiating element, and a quarter-wavelength non-radiating section. The quarter-wavelength non-radiating delay line together with the quarter-wavelength non-radiation section of the second J-pole provide a half-wave non-radiating delay line. The result is that RF energy radiated by the first and second half-wave radiating elements are in proper phase, whereby gain is achieved. RF energy is coupled to the first J-pole antenna a distance Δ above the zero impedance end of that antenna.

10 Claims, 6 Drawing Sheets

RADIAL-FREE COLLINEAR OMNI-DIRECTIONAL ANTENNA WITH GAIN AND VIRTUAL GROUND

FIELD OF THE INVENTION

The invention relates generally to antennas that radiate and receive radio frequencies (RF), and preferably for such antennas designed for use in the very high frequency (VHF) range or ultra high frequency range (UHF) that do not require radials or connection to absolute ground. Preferably such antennas should be mechanically robust over extremes of temperature and wind conditions, and should be relatively inexpensive to mass produce and transport, and should be maintenance free. Further, such antennas should exhibit gain.

BACKGROUND OF THE INVENTION

Radio frequency (RF antennas are used to receive and/or radiate RF signals. An effective antenna for use in transmission will exhibit an acceptably low standing wave ratio (SWR) at the frequencies of interest, and will present a reasonably good impedance match to the output of the transmitter, typically 50Ω to 75Ω. While some antenna designs such as beams exhibit directionality, i.e., more antenna gain in one direction compared to another, in many applications it is desired that the pattern of radiation from the antenna be omni-directional. Further it is often desired that the antenna not require ground radials, as radials undesirably increase antenna wind load, as well as the manufacturing cost. Further, radials diminish robustness of the antenna design, especially in inclement weather.

Many innovations in antenna design have come from the amateur radio community. Pioneer work in the area of so-called fractal antenna has been accomplished by Nathan Cohen (W1IR, W1YW) of Belmont, Mass., e.g., U.S. Pat. Nos. 6,104,349, 6,127,977, 6,140,975, 6,445,352, 7,019,695, and 7,701,396, among others.

Another innovation in antenna design is depicted in FIGS. 1A and 1B, namely the so-called Don Johnson screwdriver antenna, named after its late inventor Don Johnson (W6AAQ) of Esparta, Calif. Overall antenna 10 includes a whip portion 20, typically 3' to perhaps 8' in length, mounted to make electrical connection with the upper end of an inductor 30. Inductor 30 typically is formed about a non-conductive cylinder of perhaps 2" diameter and perhaps 12" length. The upper portion of housing 40 includes conductive finger stock that presses against inductor 30, effectively grounding to housing 40 all portions of inductor 40 that are within the housing. Inductor 30 and the cylinder it is formed upon can be urged vertically upward and downward within a metal cylinder housing 40 to alter magnitude of the effective inductance protruding from housing 40. A threaded rotatable shaft 80 is connected between the lower end of the inductor 30 cylinder and the rotatable shaft of a small DC motor 70. Motor 70 is typically a motor from an electric screwdriver, hence the "screwdriver" name for the antenna. Two wires from motor 70 can be applied to a plus or a minus polarity DC voltage, to cause motor 70 to rotate clockwise or counterclockwise, causing more or less of inductor 30 to lie within housing 40, which is to say to decrease or increase magnitude of the effective inductance protruding from the housing. A matching inductor 50 is formed at the base of the antenna and a length of typically 50Ω coaxial cable 60 is connected as shown. The other end of coaxial cable 60 will typically go to a transceiver, or transmitter, or receiver. Tuning antenna 10 simply involves applying plus or minus DC voltage to motor 70 to mechanically resonate the antenna to a desired frequency range. Antenna 10 can be tuned by first setting the transceiver (or receiver) to a desired frequency and then adjusting the effective length of inductor 30 by rotating motor 70 in the proper direction (by applying plus or minus voltage to motor 70) to resonate the antenna, as evidenced by a peak in amplitude of received signals.

In FIG. 1A, DC voltage has been applied to motor 70 to rotate nearly all of inductor 30 into housing 40. The effect at RF frequencies is that only the portion of inductor 30 protruding from housing 40 functions as an inductor. The antenna operates as a center loaded device whose resonance is determined primarily by the effective inductance 30 and the whip 20. In FIG. 1B, DC voltage was applied to motor 70 to rotate threaded shaft 80 such that more of inductor 30 can now resonant with whip 20. Clearly the additional effective inductance used in FIG. 1B will lower the resonant frequency of the overall antenna. Advantageously the antenna can operate continuously within a very wide range of frequencies, merely by applying DC voltage to motor 70 to cause more or less inductance to be used. In practice, many thousands of Don Johnson screwdriver antennas have been used worldwide with great success over frequencies ranging from as low as about 3.5 MHz to as high as perhaps 144 MHz.

In other applications, especially higher frequency applications, a less mechanical antenna may be desired, especially for considerations of cost and ease of construction. One common type of antenna, especially for VHF (2 m range wavelengths) and/or UHF (70 cm range wavelengths), is the so-called collinear antenna. A collinear antenna is an array of at least two dipole antennas, configured such that every element of each dipole is an extension, relative to a longitudinal antenna axis, of the other dipoles in the array. Collinear antennas can exhibit gain over an isotropic radiator.

FIG. 2A depicts a collinear antenna 90 comprising collinear elements 100, 110, 120, used with preferably at least four quarter-wavelength radials 130 mounted at the antenna base. Radials 130 function as a ground plane. Preferably coaxial cable 60 is coupled to antenna 90, with the other end of coaxial cable 60 coupled to a transceiver, a transmitter, or a receiver (not shown). Lowermost element 100 in FIG. 2A is a quarter-wavelength at the nominal frequency of interest. Intermediate element 110 is coupled to act as a half-wave delay element, and uppermost radiating element 120 preferably has a length equal to a half-wave. The various elements 100, 110, 120 can be fabricated from lengths of coaxial cable, whose center conductor is indicated by phantom lines, and whose outer shield conductor is indicated by solid lines on either side of the center conductor. Note that the collinear arrangement alternates electrical connection between the center conductor of an element and the outer conductor.

In FIG. 2A, if one tried to use quarter-wavelength element 100 with an extension half-wavelength (i.e., center-conductor to center-conductor, shield-to-shield), no additional gain would result due to phase cancellation of radiation in the quarter-wave and half-wave elements. FIG. 2B depicts voltage amplitude versus phase for the various elements of antenna 90. As confirmed by FIG. 2B, non-radiating half-wave delay element 110 provides the desired ground reference function. This results from coupling the shielded outer conductor of element 100 to the inner conductor of element 110, which inner conductor acts as a ground reference. Note at the base of antenna 90 that radials 130 are also coupled to this ground reference via the center conductor of element 100. As shown in FIG. 2A, after a quarter-wavelength at the junction of elements 100 and 110, the shield and inner conductor are swapped. At its upper end, element 110 is coupled to the lower end of half-wave coaxial element 120, again by swapping of center conductor and shield outer conductor. As the radiated radio frequency energy exits the upper end of element 120 it is back in phase with quarter-wavelength radiating element 100. If desired additional elements, i.e., another triplet of elements 100, 120, 120 could be added atop present uppermost element 120 in collinear fashion. However a point of diminishing returns effectively occurs at about four elements in that marginal further increase in gain does not warrant the cost of the additional elements.

Disadvantageously, antenna 90 requires several, typically at least four, quarter-wavelength radials 130, preferably bent downward at an angle of perhaps 45° to establish an RF ground. As noted, an RF ground reference node exists at the junction of radials 130 and the outer shield of coaxial cable 60. Radials often require machining to properly make good electrical connection at the base of antenna 90. In practice stainless steel radials are preferred for reasons of strength and electrical contact over less expensive aluminum radials. The presence of radials impacts the robustness of the antenna design. Radials can easily break off in the presence of strong winds, or by birds perching on the radials. If the radials are on the ground, they may be damaged from being walked upon. Further, the electrical conductivity between the radials and the shield of coaxial cable 60 will inevitably deteriorate over time.

FIG. 3 depicts an attempt in the prior art to eliminate radials by using a quarter-wave sleeve. Referring to FIG. 3, antenna 140 has at its base a quarter-wave element 100, then a half-wave delay element 110, above which is disposed an upper half-wave radiating element 120. These collinear elements 100, 110, 120 in antenna 140 are configured similarly to the same elements in antenna 90 in FIG. 2A, and are made from segments of coaxial cable. However rather than employ radials (as in FIG. 2A), antenna 90 employs a conductive quarter-wavelength sleeve 150 to implement an effective quarter-wavelength foldback and RF ground reference. The term "foldback" is used in that sleeve 150 covers a portion of the connecting coaxial cable 60. Sleeve 150 is commonly made of conductive brass or copper pipe, and the connection to coaxial cable 60 is typically made within the sleeve. This configuration advantageously gains robustness by eliminating radials, and exhibits a slightly lower angle of radiation that can add to transmitting range of the antenna. However the sleeve configuration can make it difficult to achieve desired low SWR due to inherent coupling between the outer shield conductor of coaxial cable 60 and the wall of sleeve 150.

FIG. 4 depicts yet another attempt in the prior art to implement an omni-directional antenna without radials. As shown in FIG. 4, a portion of this antenna looks like the letter "J", and this configuration is sometimes referred to as a "Super-J" antenna. A full description of antenna 160 may be found in QST magazine, September 1994, p. 61-62, J. Reynante (W6JRR) "An Easy Dual Band VHF/UHF Antenna." Referring to FIG. 4, the lower end of antenna 160 is a quarter wavelength matching element, typically 300Ω twinlead 170, whose two leads or wires are shorted together at the bottom 180. The RF impedance at bottom 180 is of course 0Ω, but at a distance Δ above bottom 180, the RF impedance will be close to the impedance of coaxial cable 60 to be a good match, e.g., 50Ω or so. The upper end of quarter-wavelength matching element 170 is coupled to a half-wave radiating element 190, as the upper end of quarter-wavelength matching element 170, and either end of half-wave radiating element 190 are both RF high impedances.

Note that elements 170 and 190 are disposed vertically and will exhibit vertical radiation of RF energy. By contrast, the upper end of half-wave radiating element 190 is coupled to a horizontally disposed delay element 200. Delay element 200 comprises two parallel quarter-wavelength element coupled in a horizontally-disposed "U"-shaped configuration. The horizontally polarized RF energy associated with the lower and with the upper elements of delay element 200 are 90° out-of-phase with respect to each other and thus cancel one another. Ideally the phase delay and radiation patterns associated with element 200 are perfectly out-of-phase, but in practice some phase error and associated antenna inefficiency will exist. "U"-shaped delay element 200 may be thought of as contributing an outgoing lower quarter-wavelength delay and an incoming quarter-wavelength delay. The net result is that these horizontally disposed elements represent an effective half-wave delay element 200. The upper portion of "U"-shaped delay element 200 is connected to the lower end of a vertically disposed (and vertically radiating) half-wave radiating element 210. In this fashion the antenna of FIG. 4 implements the functional equivalent of the ready access to ground that was present in the antenna of FIG. 2A. The desired overall half-wavelength delay with desired non-radiating characteristics for 180° of the phase waveform is achieved by "U"-shaped element 200.

Regrettably, antenna 160 is not robust in that delay element 200 projects out horizontally from the vertical antenna into the environment, and is difficult to reliably fasten between radiating elements 190 and 210. Alternatively some designs also seek to achieve phase delay with inductor-capacitor (LC) components rather than with an element 200. However such solutions are not optimum because losses and tolerance changes in the L and C components vary over time, which can reduce effectiveness of the desired delay function.

FIG. 5 depicts a so-called conventional "J-pole" antenna that can be fabricated from a single length of 300Ω twin lead cable, comprising lead 1 and lead 2, that has a gap or notch cut in one lead (lead 1), and whose bottom region has a short between the two leads. The lower portion of antenna 220 comprises a quarter-wavelength matching element 230, sometimes referred to as a shorting stub element, whose lower end 180 has both leads shorted together to form a low impedance end of the J-pole antenna. A perhaps 0.25" gap or notch 240 is formed in one side of the matching element (the left side in FIG. 5), cutting through one of the two wires or leads. A half-wave radiating element 250 is connected to the upper portion of quarter-wavelength matching element 230. As shown the upper end of J-pole antenna 220 is open, and is high impedance.

Thus, as used herein, the term "J-pole" antenna is understood to refer to an antenna comprising spaced-apart first and second conductive wires, e.g., twinlead, shorted together at one end to form a zero impedance first end, and a quarter-wavelength away from this zero impedance first end, an open high impedance quarter-wavelength second end. The first conductive wire (lead 1) has a notch or gap cut through the wire approximately a quarter wavelength above the zero impedance first end, and the second conductive wire (lead 2) is approximately three-quarter wavelength at resonant frequency. An RF low impedance feedpoint exists a distance Δ in each lead above the zero impedance first end. The quarter wavelength section adjacent the zero impedance first end functions as a quarter-wavelength impedance matching element, and the half-wavelength of each lead measured from the high impedance second end forms a half-wavelength radiating element.

In a conventional half-wave antenna, the antenna ends are high impedance and the antenna center is low impedance. But in a half-wave vertical dipole antenna such as antenna 220, end matching must be done at a high impedance point. As noted above, this condition is satisfied using quarter-wave shorted stub matching element 230 at the lower end of antenna 220, by having the upper end of half-wave radiating element 250 open, e.g., not shorted or connected to anything. Thus, J-pole antenna 220 exhibits high impedance at the upper end of half-wave radiator element 250, and exhibits 0Ω impedance at shorted region 180. However at a distance Δ above short 180 a good match to typically 50Ω coax feedline 60 may be found. As such, quarter-wavelength matching element 230 acts like an impedance matching transformer. Matching distance Δ is commonly on the order of perhaps 0.5" or so for an antenna resonant in the 70 cm band. In practice, distance Δ may be determined experimentally using an antenna analyzer. Further details regarding the design of antenna 220 may be found at QST magazine, February 2003, pp 38-401, E. Fong (WB6IQN), "The DBJ-1: A VHF-UHF Dual-Band J-Pole", and QST magazine, March 2007, E. Fong (WB6IQN), "The DBJ-2: A Portable VHF-UHF Roll-up J-pole Antenna for ARES".

J-pole antenna 220 is similar to a vertically oriented end-fed half-wave dipole, but with a radiation pattern closer to an ideal vertical dipole. The enhanced radiation pattern results because feedline 60 is in-line rather than perpendicular to the antenna. A well-designed J-pole antenna is a good half-wave radiator that provides about 2.1 dB gain over an isotropic radiator, but no gain relative to a half-wave antenna.

It will be appreciated that J-pole antenna 220 is omni-directional, inexpensive to fabricate, and requires no radials. In practice the antenna can be inserted within a length of UV-resistant PCV pipe that is sealed at the top and bottom, to provide a robust configuration with relatively low wind resistance. In practice J-pole antenna 220 can achieve about a 1.5 dB gain improvement over a quarter-wave ground plane antenna because it is a true half-wave antenna. In a conventional ground plane antenna such as was described in FIG. 2A, ground radials 130 were necessary to act a counter element (e.g., ground or earth). With radials bent downward from say 0° (i.e., horizontal) to about 45°, and disadvantageously a relatively high angle of radiation will result. By contrast, a J-pole such as antenna 220 has no radials and advantageously exhibits a lower angle of radiation, which results in a gain of about 1.5 dB in the horizontal plane relative to a conventional ground plane antenna.

While the J-pole provides an interesting starting point for many antenna designs, further gain may be demanded of many applications. Thus there is a need for an inexpensive, robust antenna with low wind resistance and high reliability. Preferably such antenna should provide gain beyond what a conventional J-pole antenna can provide and indeed should provide gain over a half-wave antenna. Such antenna should be omni-directional, should not require radials or special collars, and should not require an absolute ground connection.

The present invention provides such an antenna.

SUMMARY OF THE PRESENT INVENTION

The present invention provides an omni-directional collinear gain antenna that operates without radials or an absolute ground. In a preferred embodiment, two J-pole antenna sections are joined together with a quarter-wavelength non-radiating delay line disposed between the two J-poles. A first J-pole section comprising spaced-apart parallel first and second conductive leads, preferably twinlead, has a zero impedance first end and a high impedance second end with a gap in the first lead approximately a quarter-wavelength above the zero impedance first end and about a half-wavelength below the high impedance second end. An RF low impedance feedpoint, e.g., 50Ω, is located a distance Δ above the 0Ω first end on each lead. This first J-pole antenna may thus be implemented with an approximately three-quarter wavelength piece of twinlead, e.g., 300Ω twinlead. The half-wave portion of the first J-pole acts as a radiating element, whereas the quarter-wavelength matching element does not radiate any substantial RF energy.

The high impedance second end of this first J-pole is connected to the high impedance second end of a first quarter-wavelength non-radiating delay line, whose other, first, end has its first and second leads shorted together to form a low RF impedance, preferably 0Ω. This first quarter-wavelength non-radiating delay line may be a quarter-wavelength of twinlead, e.g., 300Ω twinlead, whose first lead has a notch cut into the high impedance end to remove perhaps 0.25" of the first lead. In terms of the overall antenna to be implemented, this first quarter-wavelength delay line does not radiate any substantial RF energy.

A second J-pole, substantially similar to the first J-pole antenna, has its low impedance first end coupled to the low impedance first end of the first quarter-wavelength non-radiating delay line. Similar to the first J-pole, there is a quarter-wavelength element between the low impedance first end and the region encompassing a gap or notch cut into the first lead, which quarter-wavelength element functions as a second quarter-wavelength non-radiating delay line. Thus, the first quarter wavelength non-radiating delay line and the second quarter-wavelength non-radiating delay line comprise a half-wavelength non-radiating delay line. The second J-pole has a half-wave radiating element that, like the half-wave radiating element associated with the first J-pole, radiates RF energy. Thanks to the half-wave delay present in the overall antenna, RF energy radiating into the two half-wave radiating elements is in proper phase with each other. The first and second J-pole antennas are configured with like orientation, which is to say both J-pole sections have their low impedance end facing in a first direction, e.g., down, and their high impedance end facing in an opposite second direction, e.g., up, although the up and down orientations for both J-pole sections could be reversed.

The resultant antenna is omni-directional, is collinear, requires neither a ground plane nor radials, requires no an absolute RF ground, and exhibits gain relative to a half-wave dipole antenna. The antenna may be fabricated from an approximately 1.75 wavelength (at frequency of interest) piece of twinlead, with gaps or notches formed in the first lead at the appropriate locations. The antenna is readily mass producible at low cost, has low weight and is readily shippable, and is robust in that it is of integral one-piece construction.

If desired, at least a second additional quarter-wavelength non-radiating delay line and an additional third J-pole could be connected to the high impedance second end of the second J-pole. However in practice, the somewhat marginal increase in gain that may result from adding additional quarter-wavelength non-radiating delay lines and associated J-poles seems unjustified by the additional overall antenna length and material requirements.

Other features and advantages of the invention will appear from the following description in which the preferred embodiments have been set forth in detail, in conjunction with their accompanying drawings.

DETAILED DESCRIPTION OF THE PREFERRED EMBODIMENT

Figure 5:
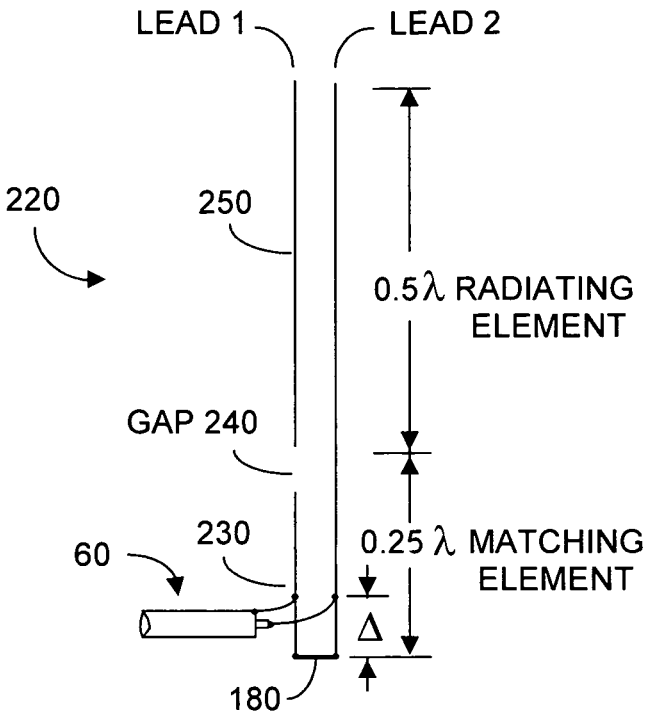
FIG. 5 (PRIOR ART)
FIG. 5 depicts an omni-directional "J-pole" antenna with slight gain that operates without radials, according to the prior art.
Figures 6A, 6B, 6C:
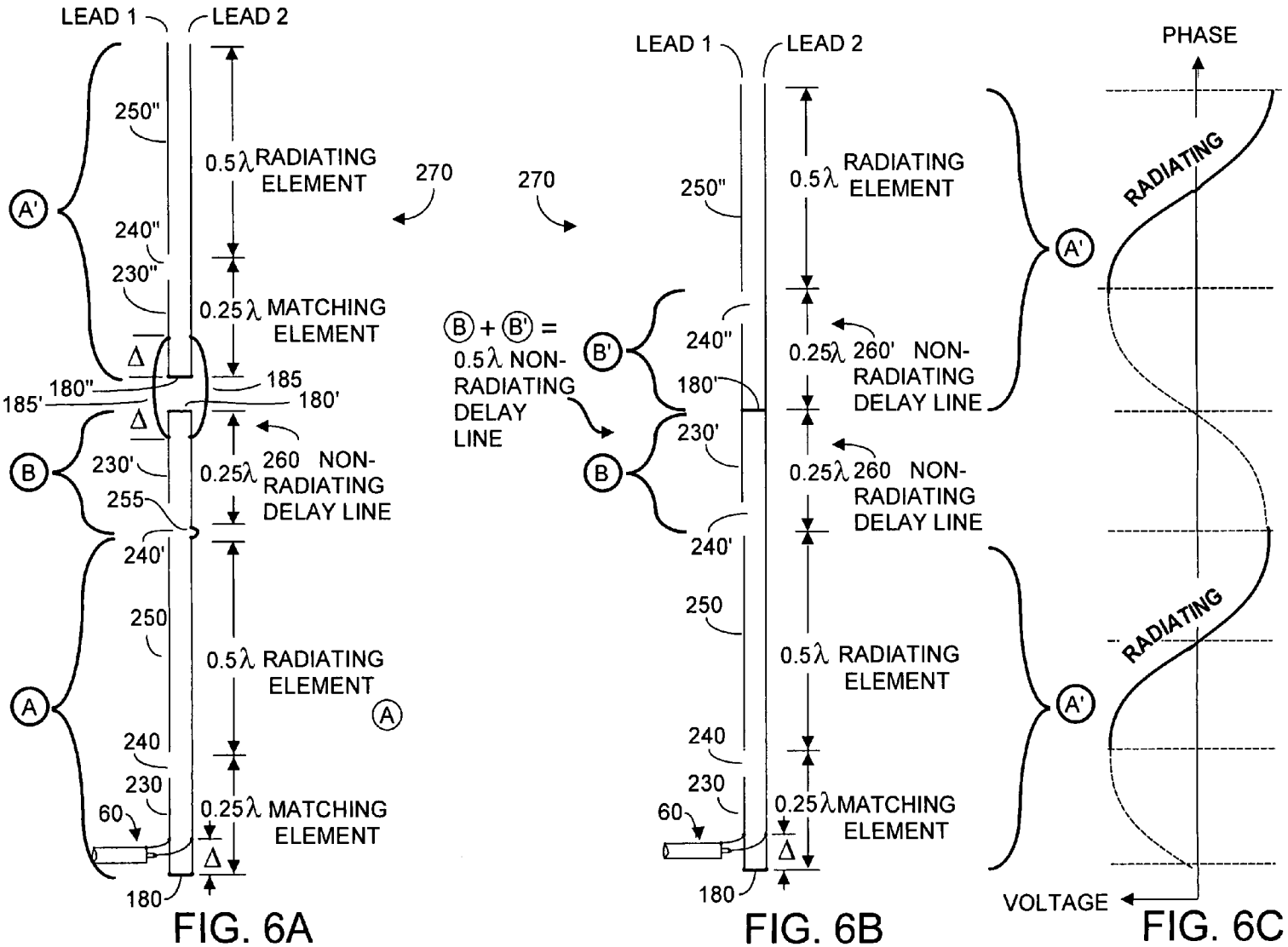
FIG. 6A depicts formation of an omni-directional gain antenna operable without radials and without an absolute ground, comprising a series connection of a first J-pole antenna, an inverted second J-pole antenna, and a third J-pole antenna, according to embodiments of the present invention.
FIG. 6B depicts an exemplary omni-directional gain antenna that operates without radials and without an absolute ground, resulting from joining together of the exemplary J-pole elements depicted in FIG. 6A, according to embodiments of the present invention.
FIG. 6C depicts voltage amplitude versus phase for various elements of the antenna of FIG. 6B, according to embodiments of the present invention.

FIG. 6A depicts an exemplary antenna 270, according to embodiments of the present invention. Antenna 270 comprises a first J-pole section denoted Ⓐ, a first quarter-wavelength non-radiating delay line section denoted Ⓑ, and a second J-pole section denoted Ⓒ. First J-pole section Ⓐ is similar to what has been described with respect to FIG. 5, and includes spaced-apart parallel first and second leads that form a quarter-wave matching element 230 whose first, lower, end has the two leads connected together by a short 180 to form an RF low impedance end, preferably 0Ω. The lead 2 side of element 230 extends about a quarter-wavelength at the nominal frequency of interest and has a high impedance second end. Lead 1 has a notch or gap 240 cut into the wire for a length of perhaps 0.25". In FIG. 6A, below the level of notch 240 is the quarter-wavelength matching element, and above the notch is a half-wavelength radiating element 250. While short 180 defines a 0Ω RF impedance, a distance Δ can be determined experimentally above the short at which an impedance that matches coaxial cable 60 can be found, preferably about 50Ω. For a nominal wavelength in the 70 cm band, the distance Δ will be on the order of perhaps 0.5". Those skilled in the art will realize that the distance Δ whereat a nominal 50Ω (or other matching RF impedance) exists can be found with the aid of an antenna analyzer. Thus first J-pole antenna section Ⓐ comprises a quarter-wavelength matching element 230 that does not radiate substantial RF energy, and a half-wavelength radiating element 250 that does radiate substantial RF energy. Although other materials may be used, first J-pole section Ⓐ may be formed from a length of twinlead, e.g., 300Ω twinlead.

In FIG. 6A, first quarter-wavelength non-radiating delay line section denoted Ⓑ comprises a quarter-wavelength 230' of spaced-apart parallel first and second leads, preferably a length of twinlead, e.g., 300Ω twinlead. Assume for the moment that the small piece of electrical wire 255 is removed. As noted the upper or second end of J-pole antenna section Ⓐ is high impedance. Similarly the lower or second section of non-radiating delay line 230' is also high impedance, being open at each lead. Note that lead 1 of this section defines a notch or gap 240' similar to notch 240. Since the lead 2 side of section Ⓑ is open and high impedance, it can be joined directly to the open, high impedance lead 2 side of J-pole section Ⓐ, e.g., with wire 255. In FIG. 6A, the upper or first end of section Ⓑ is low impedance by virtue of short 180', which connects the first and second leads to each other. It will be appreciated that section Ⓑ may be implements from a quarter-wavelength section of twinlead, e.g., 300Ω twinlead, with a notch or gap 240' cut in the first lead as noted.

Second J-pole section Ⓐ' in FIG. 6A is substantially the same as first J-pole section Ⓐ, although there is no need to make any coaxial cable feedline connection. Second J-pole section Ⓐ' has like configuration with first J-pole section Ⓐ in that each section has its low impedance end facing in a first direction, e.g., down in FIGS. 6A and 6B, and each has its high impedance end facing in an opposite direction, e.g., up in FIGS. 6A and 6B. (In some installations the first direction could be up, and the second configuration could be down.) Second J-pole section Ⓐ' includes at its lower end a non-radiating delay line 230" whose lower first end is low impedance, e.g., 0Ω by virtue of short 180", which connects the first and second leads together, and whose second end is high impedance. Lead 2 is about a quarter-wavelength long but a gap or notch 240" is cut into lead 1 as indicated. Above the level of notch 240" is formed half-wavelength radiating element 250". It is understood that second J-pole antenna Ⓐ' may be formed from an approximately three-quarter wavelength piece of twinlead, e.g., 300Ω twinlead.

FIG. 6A shows first and second connecting wires 185, 185' coupling together respective ends of lead 1 and lead 2, preferably at a distance Δ above or below the 0Ω low impedance end of section 230' or 230". For example if the RF impedance at the distance Δ is 50Ω, then wires 185, 185' are merely coupling 50Ω to 50Ω. However it is easier to simply couple together the 0Ω impedances at 180" and 180'. Such 0Ω coupling eliminates any need to determine the distance Δ for the two non-radiating delay line elements 230', 230". This in fact is what is shown in FIG. 6B.

FIG. 6B depicts a preferred embodiment of antenna 270 in which wire 255 in FIG. 6A is eliminated and lead 2 is simply a continuum in the relevant region. Also, exemplary wires 185, 185' in the embodiment of FIG. 6A are eliminated, and the junction between the low RF impedance, i.e., 0Ω, ends of elements Ⓑ and Ⓐ' is made directly at short 180', which shorts together lead 1 and lead 2 at that location. As has been noted, section Ⓑ functions as a first quarter wavelength non-radiating delay line 260. As noted, the lower section 260 of second J-pole antenna Ⓐ', denoted Ⓑ' in FIG. 6B, also functions as a second quarter-wavelength non-radiating delay line 260'. Thus collectively, quarter-wavelength sections Ⓑ and Ⓑ' function as a half-wave non-radiating delay line.

Figure 1A:
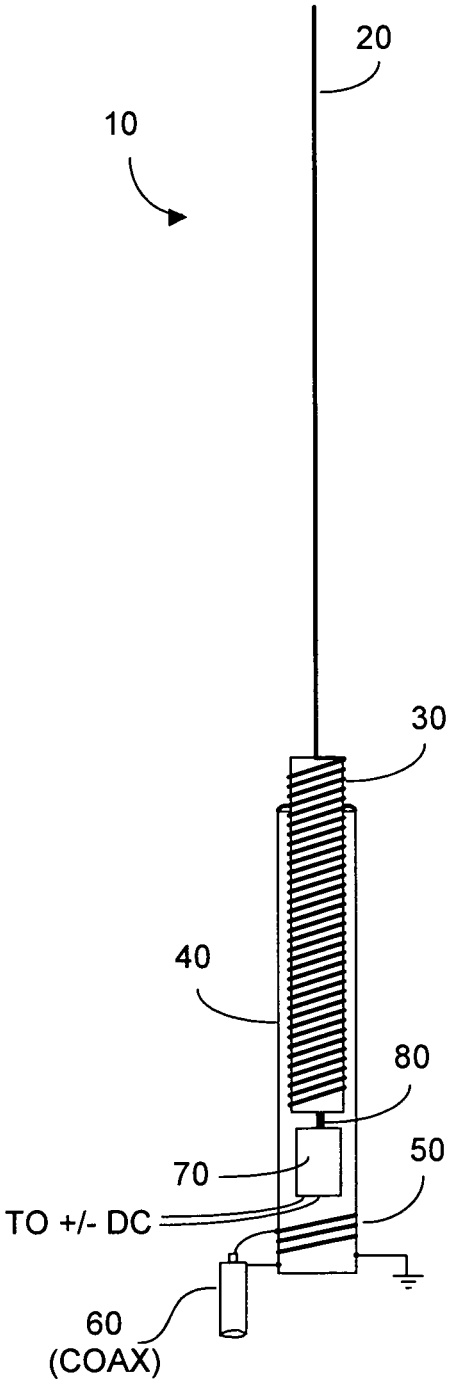
FIG. 1A (PRIOR ART)
FIGS. 1A and 1B depict a wide-frequency range, omni-directional Don Johnson type screwdriver antenna, according to the prior art.
Figure 1B:
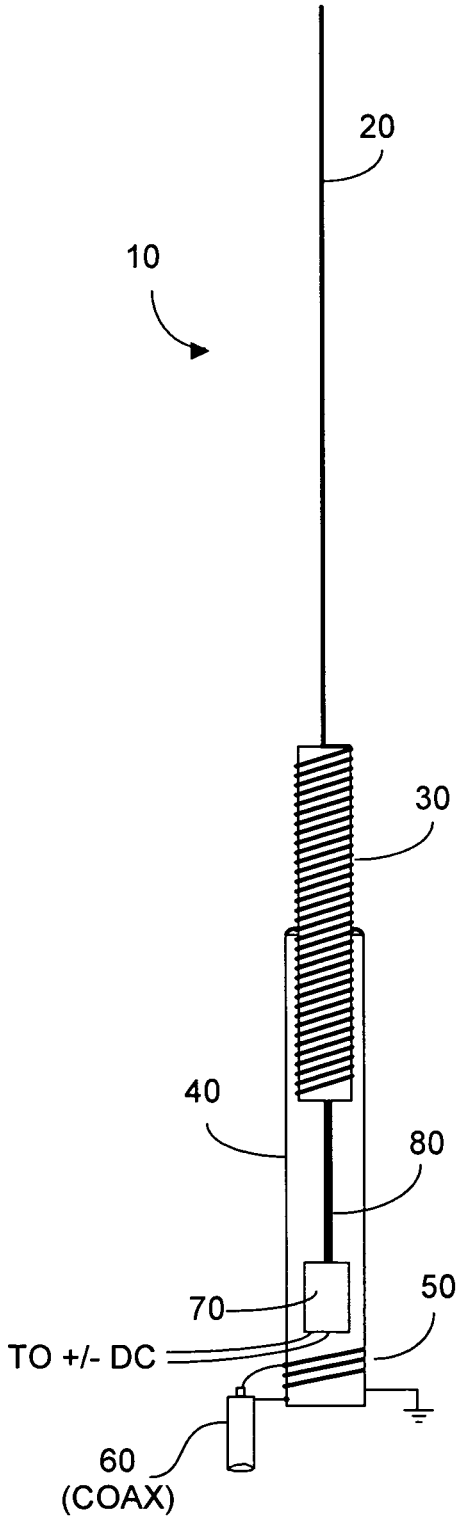
FIG. 1B (PRIOR ART)
Figures 2A, 2B:
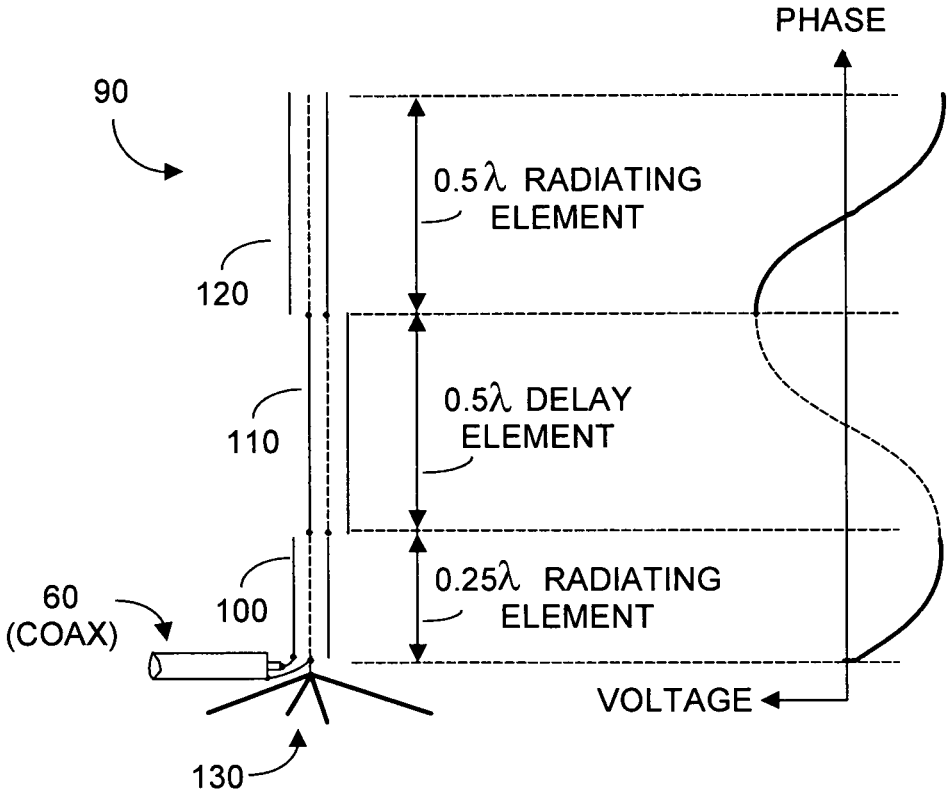
FIG. 2A (PRIOR ART)
FIG. 2B (PRIOR ART)
FIG. 2A depicts an omni-directional collinear antenna that requires radials, according to the prior art.
FIG. 2B depicts voltage amplitude versus phase for various elements of the collinear antenna of FIG. 2A, according to the prior art.
Figure 3:
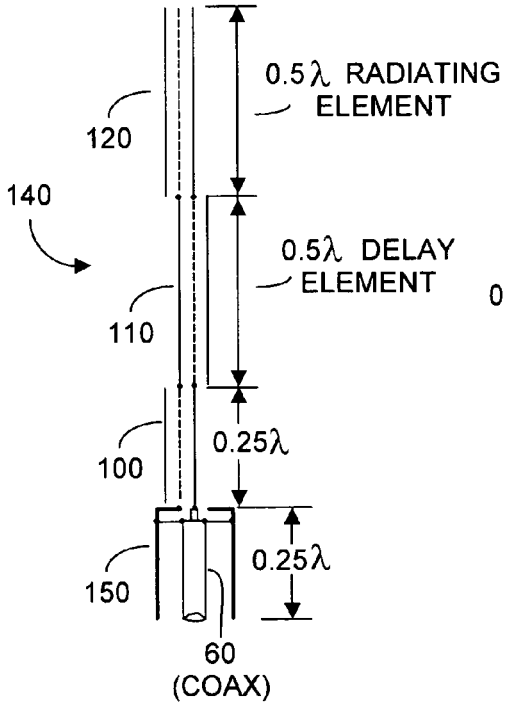
FIG. 3 (PRIOR ART)
FIG. 3A depicts an omni-directional collinear antenna that uses a quarter-wave sleeve rather than radials, according to the prior art.
Figure 4:
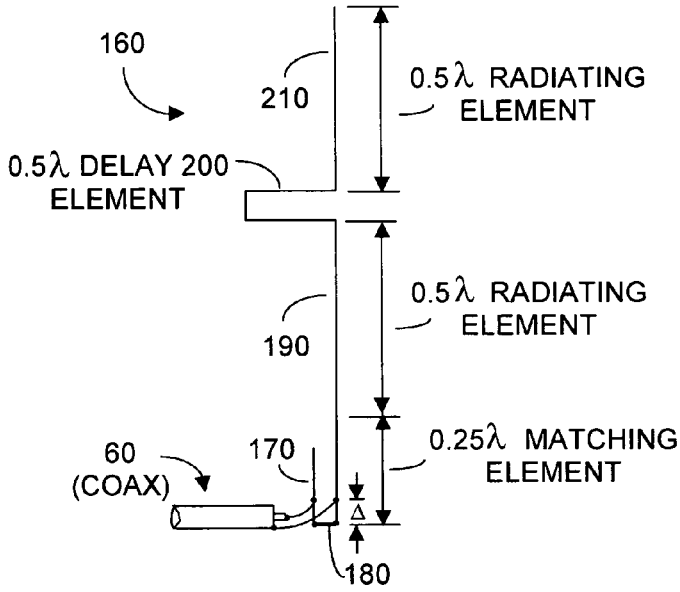
FIG. 4 (PRIOR ART)
FIG. 4 depicts a so-called "Super-J" omni-directional antenna with a half-wave delay element that operates without radials, according to the prior art.

Compare now the radiating and non-radiating sections of antenna 270 in FIG. 2B, and the corresponding phase-vs-voltage waveforms shown in FIG. 6C. At the lower end of antenna 270, section 230 functions as a quarter-wavelength matching element and do not radiate any substantial RF. Accordingly the associated portion of the phase waveform in FIG. 6C is drawn in phantom line to indicate no RF radiation.

Continuing upward along antenna 270, half-wavelength element 250 radiates RF energy, and its corresponding region of the phase waveform in FIG. 6C is drawn with solid line to indicate RF radiation. Next come the two quarter-wavelength non-radiating delay line sections, which radiate substantially no RF energy. This is indicated in FIG. C by the phantom line portion of the phase waveform. At the upper end of antenna 270, half-wave element 250" radiates RF energy, and its corresponding portion of the phase waveform in FIG. 6C is drawn with solid line. Note that the radiation from the two half-wavelength elements 250 and 250" form a continuous phase, thanks to the half-wave cancellation function carried out by first and second quarter-wavelength non-radiating sections Ⓑ and Ⓑ'. Thus antenna 270 performs substantially as intended.

Note that from top-to-bottom, antenna 270 may be implemented using a single approximately 1.75 wavelength piece of twinlead, e.g., 300Ω twinlead, with first notch 240, second notice 240' and third notch 240" cut into lead 1 at the locations noted. Each notch removes perhaps 0.25" of lead 1 wire when antenna 270 is designed for the 70 cm UHF band. Antenna 270 when designed for operation in the 70 cm UHF band exhibits 3 dB to 4 dB gain over a well made dipole, exhibits about 5.5 dB over a ground plane antenna, and exhibits about 7.1 dBi relative to an isotropic radiator. Tables 1 and 2, following, provide exemplary design data and performance data for antennas, according to embodiments of the present invention.

A somewhat marginal increase in gain can be achieved by adding an additional section Ⓑ and an additional section Ⓐ' atop the upper, high impedance end, of half-wave radiating element 250" in FIG. 6B. In practice, however, the additional three-quarter wavelength added to the height of antenna 270 seems unwarranted by the very marginal increase in gain.

Table 1 below gives exemplary characteristics for antenna 270, as depicted in FIG. 6B, for 2 m and for 70 cm wavelengths, where the antenna was designed to be disposed within PVC pipe. As noted later herein, if the antenna is not to be disposed within PVC pipe, the dimensions given in Table 1 should be increased slightly by about 2% to 5%. It is understood that tolerances given for the various dimensions given are approximate to within perhaps ±3% or so.

TABLE 1

| λ | Δ | 230 | 240, 240', 240" | 250, 250" | 230' | Gain over dipole | Gain over ground plane | Gain over isotropic radiator |
|---|---|---|---|---|---|---|---|---|
| 2 m | 1.5" | 12" | 0.25" | 37.5" | 15" | 3 dB-4 dB | 5.5 dB | 7.1 dBi |
| 70 cm | 0.5" | 4" | 0.25" | 12.5" | 5" | 3 dB-4 dB | 5.5 dB | 7.1 dBi |

Table 2 below depicts the measured gain characteristics of one, two, and three elements of an antenna according to the present invention, relative to a ground plane antenna. Also shown is the antenna gain of a so-called "rubber duck" antenna, typically about 4" in length and commonly used with hand-held transceivers relative to a ground plane antenna. The two element collinear configuration in Table 2 exhibits 5 dB gain relative to a ground plane antenna. As noted, going from a two element collinear configuration (e.g., FIG. 6B) to a three element collinear configuration does not result in appreciable gain.

TABLE 2

| ground plane | rubber duck | 1 element collinear | 2 element collinear | 3 element collinear |
|---|---|---|---|---|
| 0 dB | −3 dB | +1.5 dB | +5 dB | +5 dB |

Figure 7:
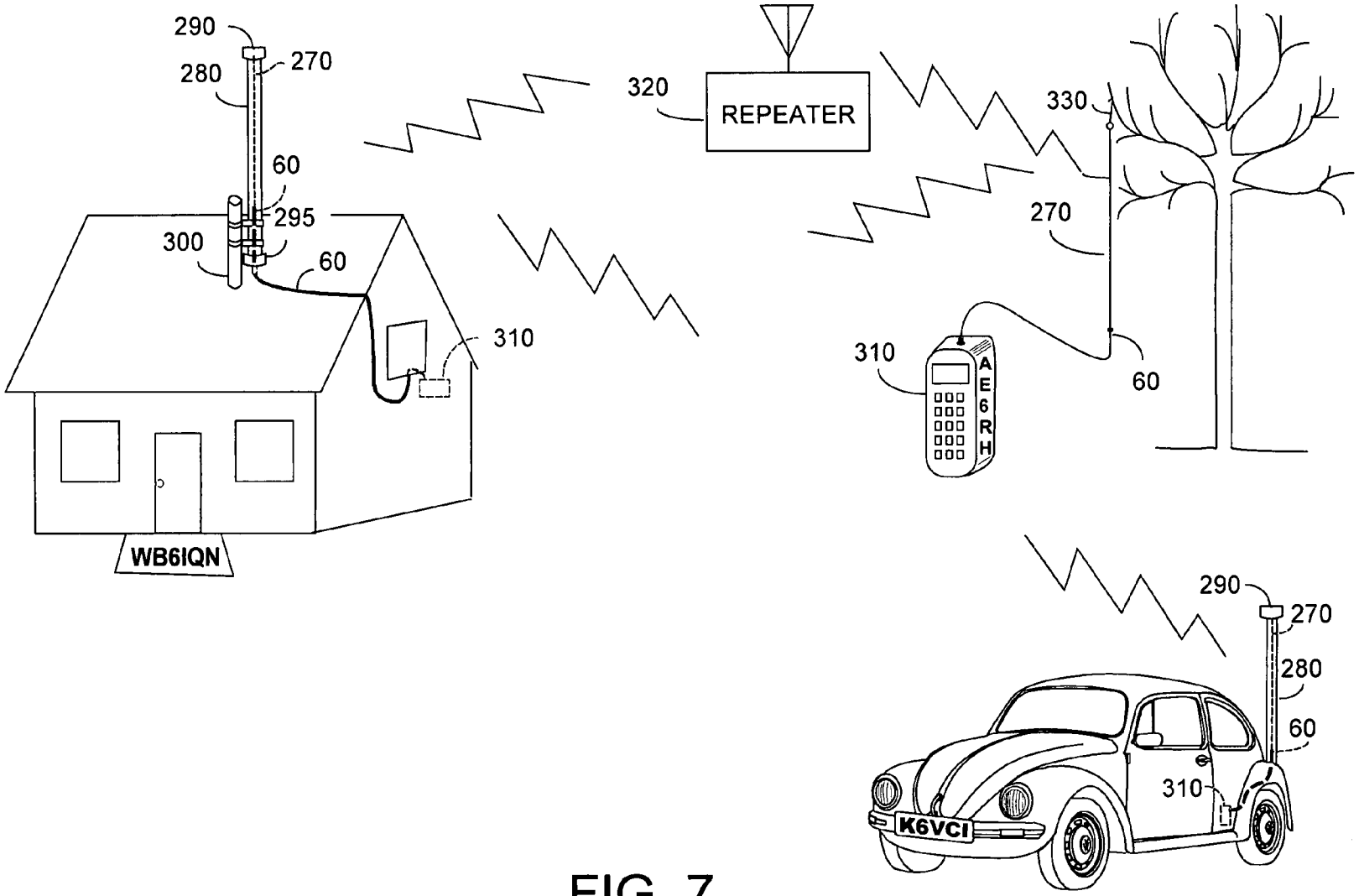
FIG. 7 depicts various deployments of embodiments of the present invention.

FIG. 7 depicts various deployments for antenna 270, as indicated in FIG. 6B. For example at the upper left of FIG. 7, antenna 270 is mounted outdoors on a roof, and is protected against the environment by a length of PVC pipe 280, which has an upper cap 290 and a lower cap 295. Those skilled in the art will appreciate that one cannot simply construct antenna 270 as shown in FIG. 6B designed for use in open air, and then insert the antenna into pipe 280 without experiencing antenna detuning due differences in velocity factors between air and PVC pipe. In practice 0.75" diameter 200 PSI PVC pipe has been found very suitable as a protective sheath material, if such is desired, for an antenna according to the present invention. In practice one can arrive at appropriate dimensions for an antenna that will be disposed within PCV pipe as follows. Initially two independently working J-pole sections Ⓐ and Ⓐ' are fabricated. RF is coupled to one of these J-pole sections, e.g., section Ⓐ via coaxial cable 60, and quarter-wavelength matching element 230 is adjusted in length until there is no appreciable change in standing wave ratio (SWR) when the J-pole is inserted into a length of PVC pipe.

Generally if the quarter-wavelength matching section is too long, resonant frequency will be lower than desired, and if this section is too short in length, the resonant frequency will be higher than desired. However trial and error will result in dimensions for quarter-wavelength matching section 230, such as shown in Table 2 above. Once the quarter-wavelength section dimension is arrived at, the precise length of the half-wave radiating element 250 can be adjusted, e.g., by cutting off quarter-inch increments from the upper high impedance end, until there is no substantial detuning of the J-pole section when inserted into the length of PVC pipe. The dimensions arrived at for the first J-pole section Ⓐ may be used to fabricate the second J-pole section Ⓐ'. Section Ⓑ is tuned for lowest SWR at resonant frequency, similar to what has been described for section Ⓐ. With care, precise dimensions for the various sections Ⓐ, Ⓑ and Ⓐ' comprising antenna 270 in FIG. 6B can be arrived at such that the antenna characteristics when inserted within a length of PVC pipe will be as desired.

Within the PVC pipe one may suspend antenna 270 from the upper cap, although in practice if one uses conventional 300Ω twinlead to construct the antenna, the twinlead itself is sufficiently rigid to require no suspension at all. Preferably the lower region of the PVC pipe will extend 10" or so beyond the lower region 180 of antenna 270. This is to provide 10" of PVC pipe mast for mounting, such that mounting will not detune the quarter-wavelength matching element 230. Thus perhaps 10" of coaxial cable 60, e.g., RG-174, will be within the PVC. A suitable coaxial type connector, e.g., SO-239 or N-type, may be mounted to the lower end cap. The distal end of the 10" or so length of coaxial cable within the PVC tubing will be connected to this connector. External to the end cap, coaxial cable 60 will terminate in an appropriate mating connector.

The completed antenna may be slid into a suitable length of PVC tubing 280, see FIG. 7. It is not necessary to anchor the antenna within the PVC tubing as the 300Ω twin lead and lengths of RG-174A are sufficiently rigid. A suitable connector, e.g., SO-239 connector, N-type, or chassis mount screw type Amphenol® 554-77 connector may be attached at the bottom of lower end cap 295. Within the PVC pipe, a 10" so length of coaxial cable will coupled between the connector and the Δ impedance-matching regions of quarter-wavelength matching element 230. It is preferred that the overall length of the PVC pipe be about 10" longer than the antenna length. This will permit about 10" of space below the lower end of the antenna within the PVC such that mounting the PVC to a mast, e.g., 300 with clamps 310 or other mechanism will not detune the sensitive lower quarter-wavelength matching section 230. It is preferred that the antenna be clamped (for mounting) only at the bottommost 10" of PVC length to assure optimum performance of the antenna within minimal detuning effects from the adjacent environment, such as a mounting mast.

FIG. 7 depicts different embodiments of the present invention used in a mobile configuration, in a handheld transceiver configuration, and in a base station configuration. Thus in the deployment shown at the upper left of FIG. 7, a roof-mounted antenna 270 is protected within a PVC pipe 280. The feedline coaxial cable 60 is shown entering the building adjacent a window and is coupled to the RF connector of an electronic device 310, e.g., a transceiver, receiver, or transmitter suitable for use at the wavelengths for which antenna 270 was designed. Typically electronic device 310 is a transceiver, which means it can transmit and can receive at the frequencies of interest. Often device 310 will communicate via a repeater 320, which can receive a relatively weak incoming signal, perhaps from device 310, and rebroadcast it, typically on a different frequency or band, often using an antenna disposed in a favorable location, perhaps atop a tall tower. Of course device 310 can also communicate directly with other equipment 310, without recourse to a repeater, e.g., in so-called simplex mode.

At the upper right corner of FIG. 7, device 310 is a low power, typically 3 W to 5 W, handheld transceiver, show coupled to antenna 270 via coaxial cable 60. The upper end of antenna 270 is shown connected by a string or the like 330 to an overhead branch of a tree. In an emergency situation where the user of the handheld transceiver must make radio communication to summon help, the several dB gain provided by antenna 270 can well make the difference between successful communications and no communications. Advantageously it will be appreciated that antenna 270 can literally be rolled up and stuffed in a backpack or even a pocket, while camping. In practice antenna 270 can safely handle RF transmitted power in the range of about 50 W.

At the lower right corner of FIG. 7, antenna 270 is again protected by PCV tubing and is mounted at the rear of a vehicle in a mobile configuration. Cable 60 is brought into the vehicle and coupled to device 310, which is often hidden in the trunk or other out-of-sight location to minimize theft. In such installations a remote head connects electrically to device 310 and may be mounted by the driver's seat, with connection for a microphone, and with full control over the remotely located device.

To summarize, the present invention provides an omni-directional collinear gain antenna that can be fabricated from a single length of twinlead, and that operates without radials or an absolute ground. The resultant antenna is inexpensive to fabricate, is light weight and thus readily and inexpensively shipped, and can be folded-up and kept in a backpack, or a glove compartment for use when needed. The 5 dB gain provided by such an antenna is substantial, especially when compared to the performance of the commonly used "rubber-duck" antennas found on handheld VHF and/or UHF low power transceivers.

Modifications and variations may be made to the disclosed embodiments without departing from the subject and spirit of the invention as defined by the following claims.

What is claimed is:

1. An omni-directional antenna operable absent ground radials and providing at least 2 dB gain at a chosen wavelength relative to a dipole, comprising:

a first J-pole antenna that includes a half-wavelength radiating element, a quarter-wavelength matching section, and has a low impedance first end and a high impedance second end, and has an RF feedpoint impedance a distance Δ above said low impedance first end;

a second J-pole antenna that includes a half-wavelength radiating element, a quarter-wavelength non-radiating delay line section, and has a low impedance first end and a high impedance second end;

a quarter-wavelength non-radiating delay line disposed intermediate said first J-pole antenna and said second J-pole antenna, and having a low impedance first end that is electrically connected to said low impedance first end of said second J-pole antenna, and having a high impedance second end that is electrically connected to said high impedance second end of said first J-pole antenna;

wherein collectively said quarter-wavelength non-radiating delay line section of said second J-pole antenna and said quarter-wavelength non-radiating delay line form a half-wavelength non-radiating delay line;

where RF energy radiated by said half-wavelength radiating element of said first J-pole antenna and radiated by said half-wavelength radiating element of said second J-pole antenna are in proper phase;

wherein at least 2 dB gain relative to a dipole antenna is achieved.

2. The antenna of claim 1, wherein at least one of said first J-pole antenna, said second J-pole antenna, and said quarter-wavelength non-radiating delay line is fabricated from twinlead.

3. The antenna of claim 1, wherein said antenna is fabricated from a single length of twinlead.

4. The antenna of claim 1, wherein:

said first J-pole antenna section comprises a first lead and a second lead, each lead being about three-quarter wavelength long and spaced-apart and parallel to each other, said first lead and said second lead joined together at a low impedance first end, and being open at a high impedance second end, said first lead defining a notch approximately a quarter-wavelength above said low impedance first end, a region of said first J-pole extending about one quarter-wavelength above said low impedance first end functioning as a non-radiating impedance matching element, and a remainder of said first J-pole comprising a half-wavelength radiating element.

5. The antenna of claim 1, wherein:

said second J-pole antenna section comprises a first lead and a second lead, each lead being about three-quarter wavelength long and spaced-apart and parallel to each other, said first lead and said second lead joined together at a low impedance first end, and being open at a high impedance second end, said first lead defining a notch approximately a quarter-wavelength above said low impedance first end, a region of said first J-pole extending about one quarter-wavelength above said low impedance first end functioning as a non-radiating delay line element, and a remainder of said second J-pole comprising a half-wavelength radiating element.

6. The antenna of claim 1, wherein:

said quarter-wavelength non-radiating delay line comprises a first lead and a second lead, each lead being about one-quarter wavelength long and spaced-apart and parallel to each other, said first lead and said second lead joined together at a low impedance first end, and being open at a second end; having a low impedance first end and a high impedance second end.

7. The antenna of claim 1, wherein:

said first J-pole antenna section comprises a first lead and a second lead, each lead being about three-quarter wavelength long and spaced-apart and parallel to each other, said first lead and said second lead joined together at a low impedance first end, and being open at a high impedance second end, said first lead defining a notch approximately a quarter-wavelength above said low impedance first end, a region of said first J-pole extending about one quarter-wavelength above said low impedance first end functioning as a non-radiating impedance matching element, and a remainder of said first J-pole comprising a half-wavelength radiating element;

said second J-pole antenna section comprises a first lead and a second lead, each lead being about three-quarter wavelength long and spaced-apart and parallel to each other, said first lead and said second lead joined together at a low impedance first end, and being open at a high impedance second end, said first lead defining a notch approximately a quarter-wavelength above said low impedance first end, a region of said first J-pole extending about one quarter-wavelength above said low impedance first end functioning as a non-radiating delay line element, and a remainder of said second J-pole comprising a half-wavelength radiating element; and said quarter-wavelength non-radiating delay line comprises a first lead and a second lead, each lead being about one-quarter wavelength long and spaced-apart and parallel to each other, said first lead and said second lead joined together at a low impedance first end, and being open at a second end; having a low impedance first end and a high impedance second end;

said high impedance second end of said quarter-wavelength non-radiating delay line coupled to said high impedance second end of said first J-pole antenna; and said low impedance first end of said quarter-wavelength non-radiating delay line coupled to said low impedance first end of said second J-pole antenna.

8. The antenna of claim 1, wherein said antenna is fabricated from a single piece of twinlead approximately 1.75 wavelengths long.

9. The antenna of claim 1, wherein said antenna has at least one characteristic selected from a group consisting of (a) said antenna is fabricated from 300Ω twinlead, (b) said antenna has an RF feedpoint impedance of about 50Ω, (c) said antenna is resonant in a 70 cm band, (d) said antenna is resonant in a 2 m band, and (e) said antenna is collinear.

10. The antenna of claim 1, wherein said antenna has at least one gain characteristic selected from a group consisting of (a) gain of about 3 dB relative to a dipole antenna, (b) gain of about 4 dB relative to a dipole antenna, (c) gain of about 5.5 dB relative to a ground plane antenna, and (d) gain of about 7.1 dBi.

* * * * *